US005988588A

United States Patent [19]

Allen et al.

[11] Patent Number: 5,988,588

[45] Date of Patent: Nov. 23, 1999

[54] CONTROL MODULE FOR BATTERY-OPERATED FAUCET

[75] Inventors: Charles S. Allen, Kenilworth; Martin E. Marcichow, Hoffman Estates; Richard A. Nortier, Westchester, all of Ill.

[73] Assignee: Asloan Valve Company, Franklin Park, Ill.

[21] Appl. No.: 09/039,673

[22] Filed: Mar. 16, 1998

[51] Int. Cl.[6] ..... E03C 1/05; F16K 31/02

[52] U.S. Cl. ..... 251/129.04; 251/129.01; 4/623

[58] Field of Search ..... 251/129.01, 129.04; 4/623; 224/902

[56] References Cited

U.S. PATENT DOCUMENTS

| | | | |
|---|---|---|---|
| 4,886,207 | 12/1989 | Lee et al. | 251/129.04 X |
| 5,401,592 | 3/1995 | Gilpin et al. | 429/97 |
| 5,412,816 | 5/1995 | Paterson et al. | 4/623 |
| 5,415,955 | 5/1995 | Kobayashi et al. | 429/97 |
| 5,445,900 | 8/1995 | Miller, Jr. et al. | 429/1 |
| 5,476,729 | 12/1995 | Miller, Jr. et al. | 429/1 |
| 5,489,484 | 2/1996 | Wheeler et al. | 429/98 |
| 5,506,749 | 4/1996 | Matsuda | 361/683 |
| 5,515,303 | 5/1996 | Cargin, Jr. et al. | 364/708.1 |
| 5,549,273 | 8/1996 | Aharon | 251/129.04 |
| 5,586,746 | 12/1996 | Humpert et al. | 251/129.04 |
| 5,618,023 | 4/1997 | Eichholz | 251/129.04 |
| 5,694,653 | 12/1997 | Harald | 4/623 |
| 5,813,655 | 9/1998 | Pinchott et al. | 251/129.04 |
| 5,868,311 | 2/1999 | Cretu-Petra | 251/129.04 X |
| 5,902,080 | 5/1999 | Kopras | 409/182 |

*Primary Examiner*—John Rivell
*Assistant Examiner*—Meredith H. Schoenfeld
*Attorney, Agent, or Firm*—Dorn, McEachran, Jambor & Keating

[57] ABSTRACT

A battery-powered faucet control module has a housing, with a base portion and a cover portion. The cover portion is removably attached to the base portion. There is an electric control board mounted in the housing base portion and an electrically-operated control valve is associated with the housing and electrically connected to the control board. There is a cavity in the housing base portion and a removable battery pack is positioned within the cavity. The battery pack has positive and negative contact straps on the exterior thereof. There are positive and negative spring contacts connected to the electric control board and such spring contacts are in engagement with the positive and negative contact straps when the battery pack is positioned within the housing cavity.

10 Claims, 4 Drawing Sheets

CONTROL MODULE FOR BATTERY-OPERATED FAUCET

THE FIELD OF THE INVENTION

The present invention relates to battery-operated faucets and more specifically to control modules for such faucets. Typically, the control module for a battery-powered faucet is located beneath the sink and it is necessary that both battery replacement and adjustment of the sensor controls be done at the control module in its location beneath the sink. Particularly for battery replacement, this is a time consuming and at times troublesome and awkward operation. The present invention permits battery replacement to be done away from the control module by using an insertable battery pack as the power for the electrically-operated faucet. The cover of the control module is removed from the module in its below-the-sink position, the battery pack is slid out, and then the batteries may be replaced at the convenience of the maintenance person. The control module further includes the necessary protection to prevent water seepage from entering the control module, as there is such potential in the environment of use.

SUMMARY OF THE INVENTION

The present invention relates to control modules for battery-operated faucets and in particular to an improved control module which protects the interior against the environment and utilizes a removable battery pack, for ease of battery replacement.

Another purpose of the invention is to provide a control module for the described environment which is simple in construction and reliable in function.

Another purpose of the invention is a control module for the described environment utilizing a simply constructed insertable battery pack for ease of battery replacement and for making positive contact with a printed circuit board within the control module.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The use of sensor-operated battery powered faucets are common in public washrooms. All such faucets have a sensor which is normally positioned to detect the presence of a user's hand beneath the faucet spout, a control module usually located beneath the sink and a source of power. Although initially many such installations used conventional electric power, battery power is now the power source of choice. The location of the control module beneath the sink is an awkward location for maintenance personnel. Batteries have to be periodically changed and at times there may of necessity be an adjustment of the electrical circuit controls that regulate operation of the sensor. The present invention specifically provides a control module, for location beneath a faucet sink, with a removable cover and with a replaceable battery pack. The battery pack may be easily removed so that the batteries may be replaced without the necessity of the maintenance person remaining beneath the sink. The battery pack requires very low insertion and removal forces and has spring straps which will make contact with spring contacts, which in turn are connected to the underside of the PC board when the printed circuit board is mounted in place. This eliminates the necessity of secondary fasteners or connections between the batteries or source of power and the printed circuit board. It is preferred that there be a retention clip on the battery pack so as to prevent the batteries from accidentally falling from the pack as the pack is inserted and removed from the control module.

Figure 1:
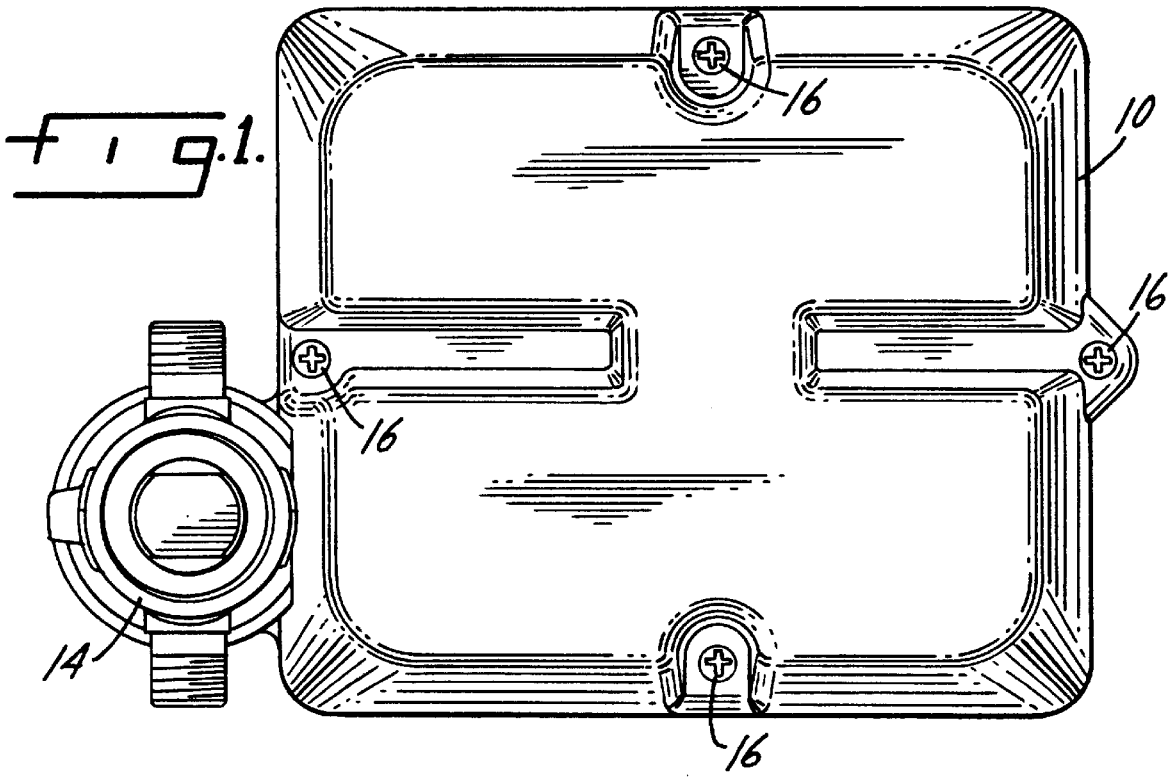
FIG. 1 is a top plan view of the control module.
Figure 2:
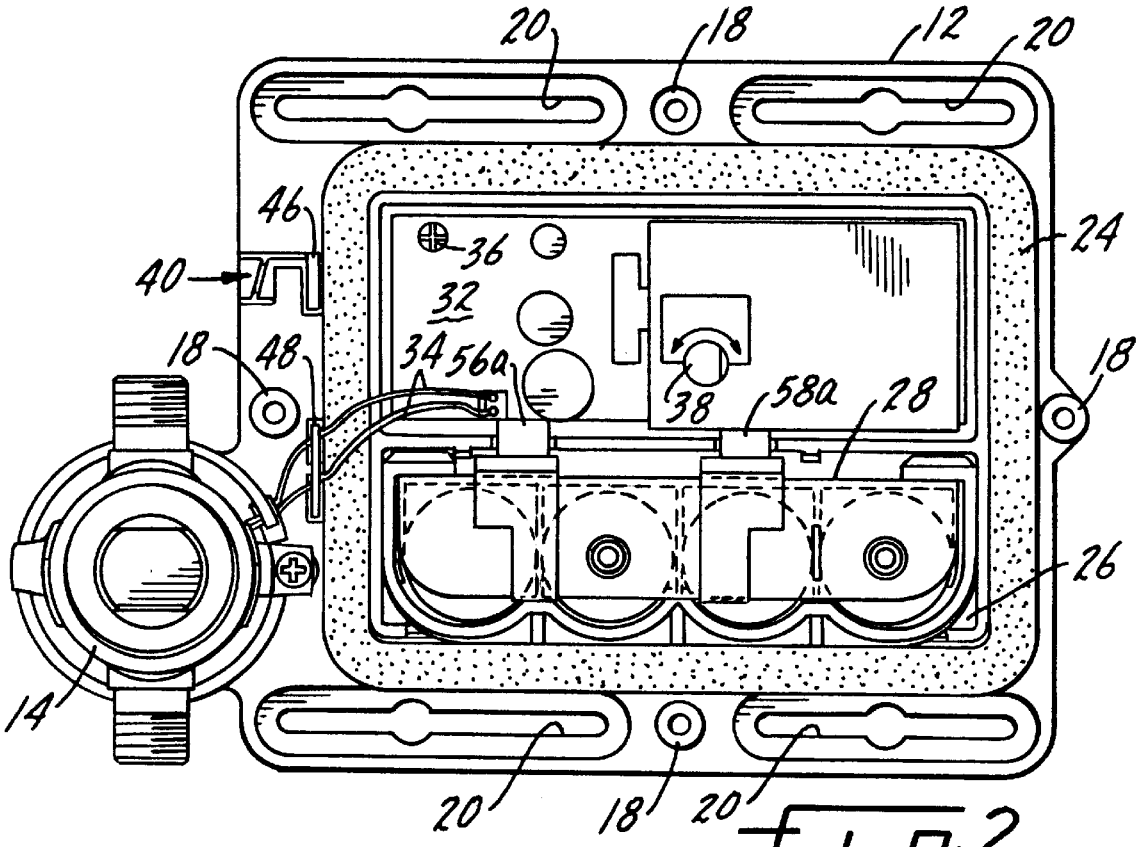
FIG. 2 is a top view of the control module base, with the cover removed.
Figure 3:
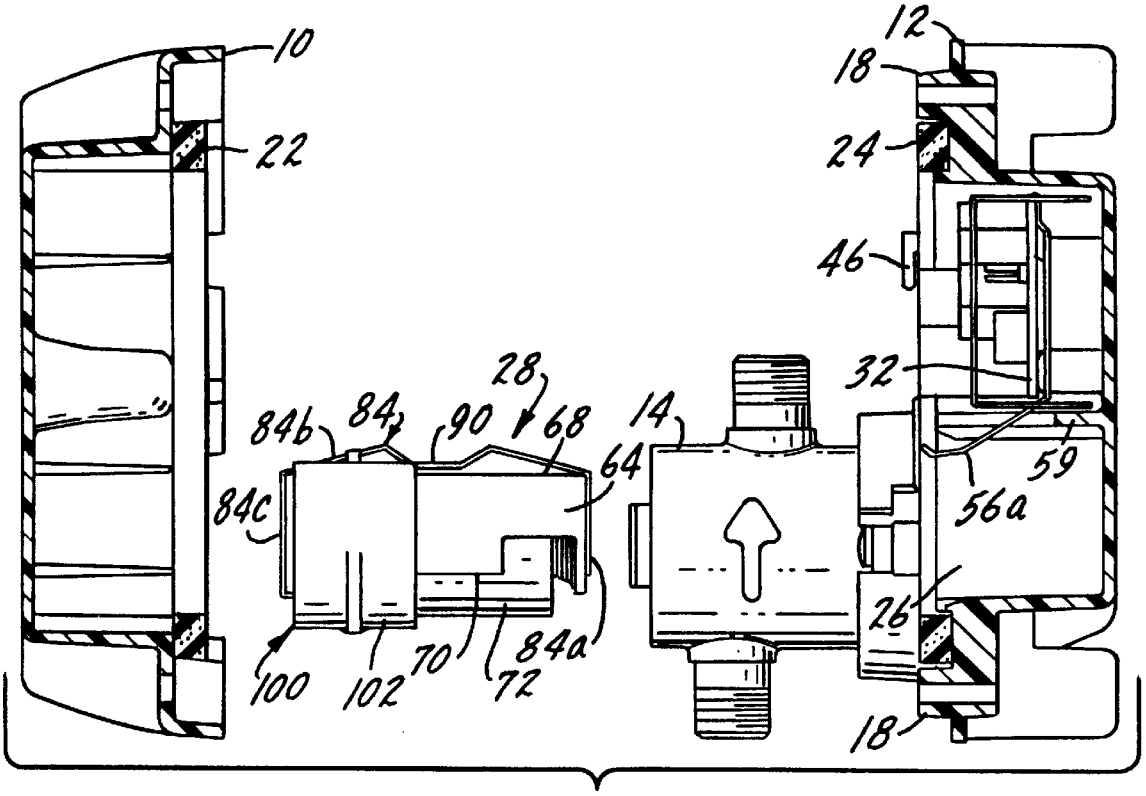
FIG. 3 is an exploded side view, in part section, illustrating the control module base, the control module cover, and the battery pack.

As particularly shown in FIGS. 1, 2 and 3, the control module includes a cover 10 and a base 12. There is a solenoid valve 14 attached to one side of the base 12 and the solenoid will be electrically-operated to control the flow of water to the faucet. As illustrated in FIG. 1, there are four fasteners 16 which will be used to screw the cover 10 to the base 12. The base has bosses 18 for accepting the threaded fasteners 16. The base 12 has a plurality of slots 20 for use in mounting the control module at a desired location beneath the sink. The use and function of the slots are described in more detail in U.S. Pat. No. 5,549,487, owned by the assignee of the present application, Sloan Valve Company of Franklin Park, Ill. The disclosure of the '487 patent is herein incorporated by reference.

In order to insure that the interior of the control module is sealed from the surrounding environment, there is a peripheral gasket 22 secured to the cover 10 and a peripheral gasket 24 secured to the base 12. When the cover and base are attached together, members 22 and 24 will completely seal the interior of the control module.

The base 12 has a first cavity 26 which will receive the battery pack indicated at 28 in FIG. 2. The base 12 has a second cavity 30 within which will be located the printed circuit board and the spring contacts connecting the PC board with the battery pack.

The PC board is indicated at 32 in FIG. 2 and has wired connections 34 with the solenoid valve 14. The PC board may be fastened by screws 36 into the cavity 30. The PC board may include a range adjustment control 38 for use in adjusting the sensor associated with the faucet.

Figure 4:
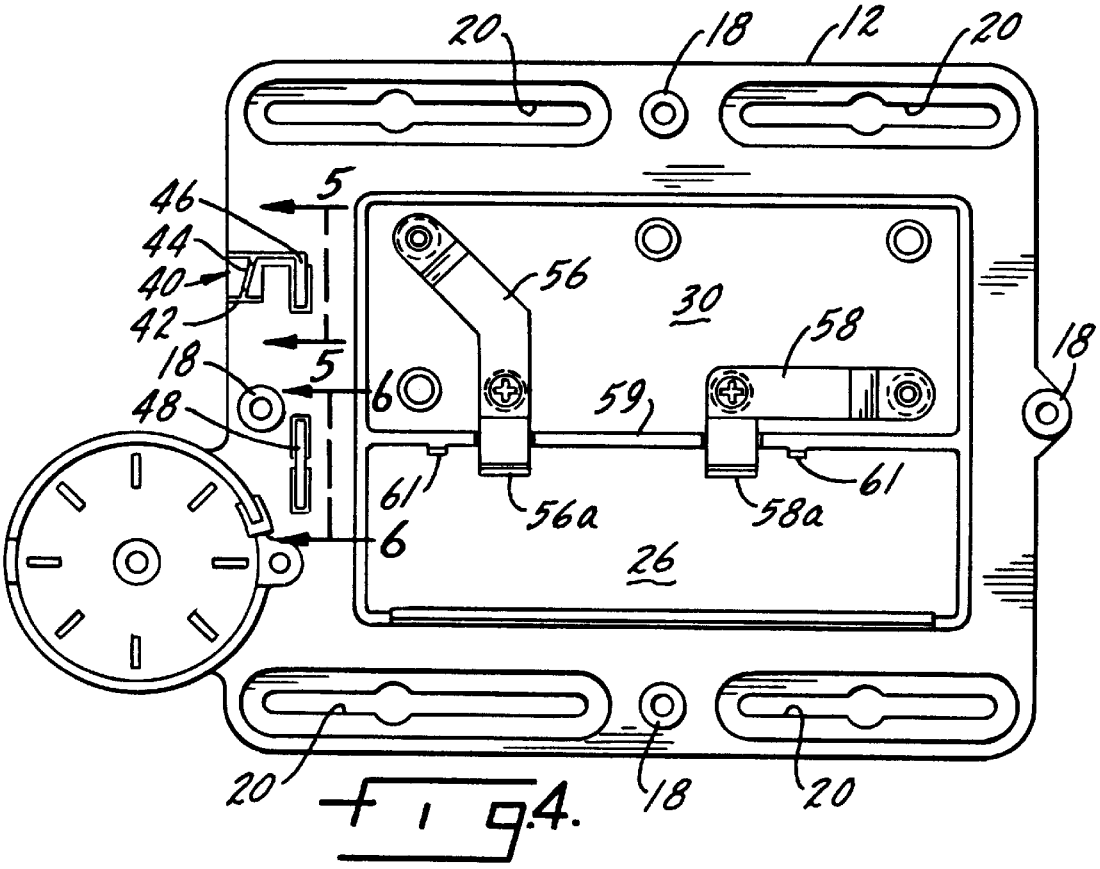
FIG. 4 is a top view of the control module base with the printed circuit board and solenoid removed.
Figure 5:
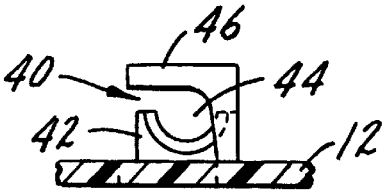
FIG. 5 is a section along plane 5—5 of FIG. 4.

FIG. 5 illustrates a sensor cable retainer indicated generally at 40 and located on the base, as illustrated in FIG. 4.

The retainer 40 includes a base 42 having a semicircular opening 44 and an overlying holder 46 which will retain the sensor cable in its proper location where it extends through the control module.

Figure 6:
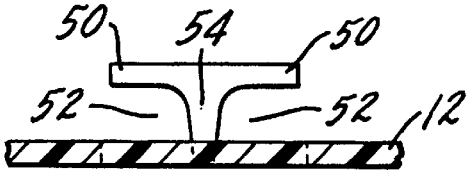
FIG. 6 is a section along plane 6—6 of FIG. 4.

FIG. 6 illustrates the retainers for holding the wires 34 that connect the PC board 32 with the solenoid 14. A finger 48 has a pair of cantilever arms 50 extending in opposite directions and defining slots 52 which are separated by a portion 54 of the finger 48. The wires 34 will lie within the openings 52 as they extend from the PC board to the solenoid, but within the confines of the control module.

As particularly illustrated in FIG. 4, there are a pair of spring contacts 56 and 58 attached to the base 12 within the cavity 30. Spring contact 56 is the positive contact and spring contact 58 is the negative contact. Each of these contacts has cantilever arms 56*a* and 58*a* which extend through a dividing wall 59 into battery pack cavity 26. The cantilever arms are illustrated in FIG. 3. FIG. 3 also illustrates how the PC board 32 overlies the spring contacts and the underside of the PC board will be connected to the spring contacts for appropriate supply of power to the control module electrical elements. Dividing wall 59 has alignment ribs 61 on the cavity 26 side of the wall to insure that the battery pack will be installed in the single orientation required for proper operation.

The battery pack 28 is shown in detail in FIGS. 7 through 11. It includes side walls 60 and 62 connected by end walls 64 and 66, with all of the walls being integral with a bottom 68. Each of the end walls 64 and 66 has an inwardly-curved retainer 70 to hold the batteries in position within the battery pack. The battery pack has positions for four batteries although this is not essential to the invention, one such battery being shown at 72 in FIG. 7. There are cavities 74 for each of the batteries and each cavity includes a coil spring 76 for making contact with the battery positive terminal and a contact 78 for making contact with a battery negative terminal. Each of the positive terminals is connected to an adjacent negative terminal by an interior arm 80 of a coil spring 76. Thus, all four batteries are connected in series.

There are two battery contact straps, a positive strap indicated at 84 and a negative strap indicated at 86. The positive contact strap 84 is connected to contact 78 by a rivet 82 on the left side of the battery pack, as shown in the drawings. Strap 84 has a portion 84*b* which extends along the bottom 68 of the battery pack housing and then has a further portion 84*c* which extends along wall 60 and wraps around the end of wall 60 as shown at 84*d*. Thus, strap 84 is secured at its opposite ends to the battery pack and is positioned for engagement with positive spring contact 56 at its cantilever arm 56*a*.

Figure 7:
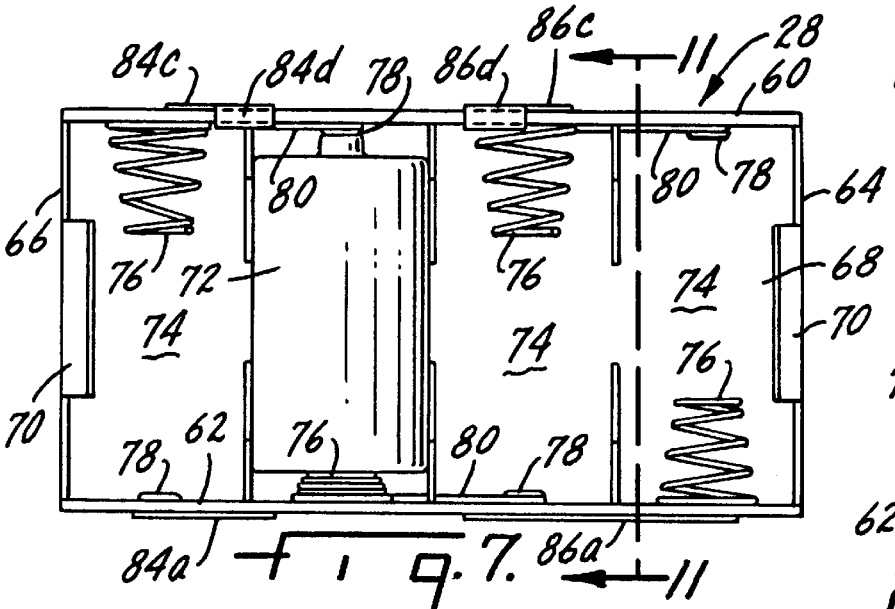
FIG. 7 is a front view of the battery pack, with one battery shown positioned therein.
Figure 8:
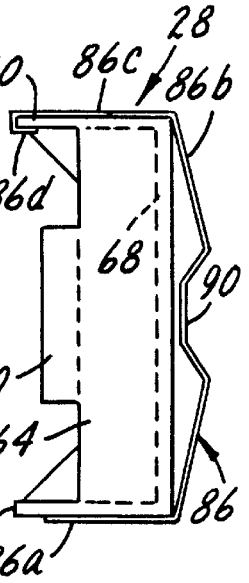
FIG. 8 is a side view of the battery pack.
Figure 9:
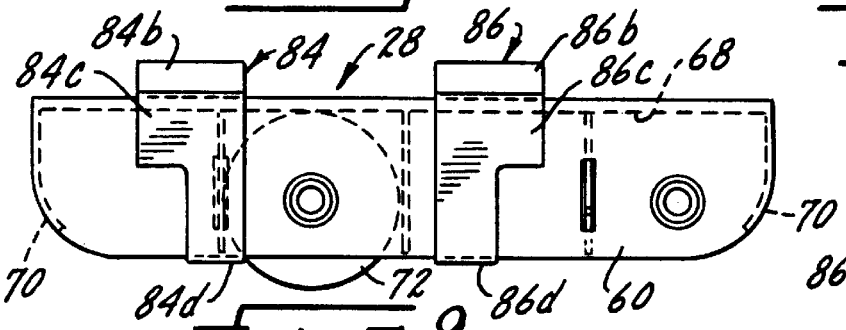
FIG. 9 is a top view of the battery pack.
Figure 10:
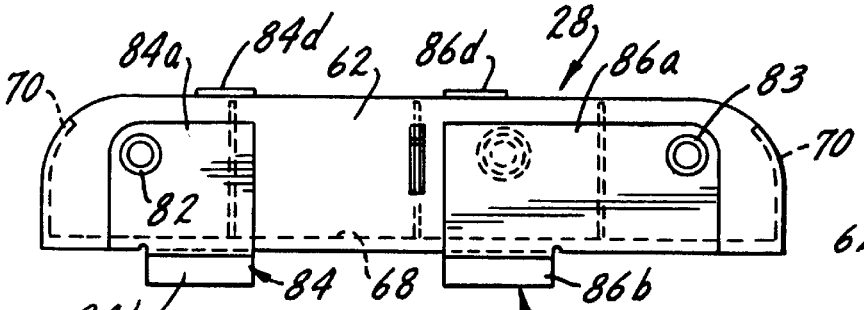
FIG. 10 is a bottom view of the battery pack.
Figure 11:
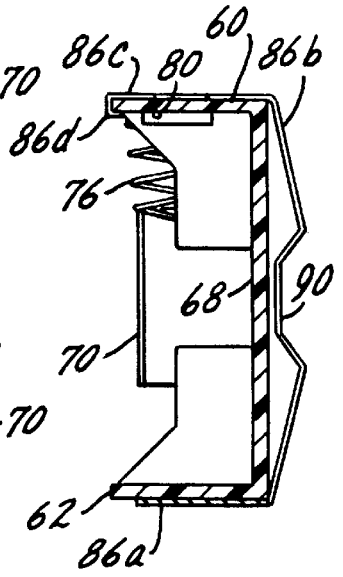
FIG. 11 is a section along plane 11—11 of FIG. 7.
Figure 12:
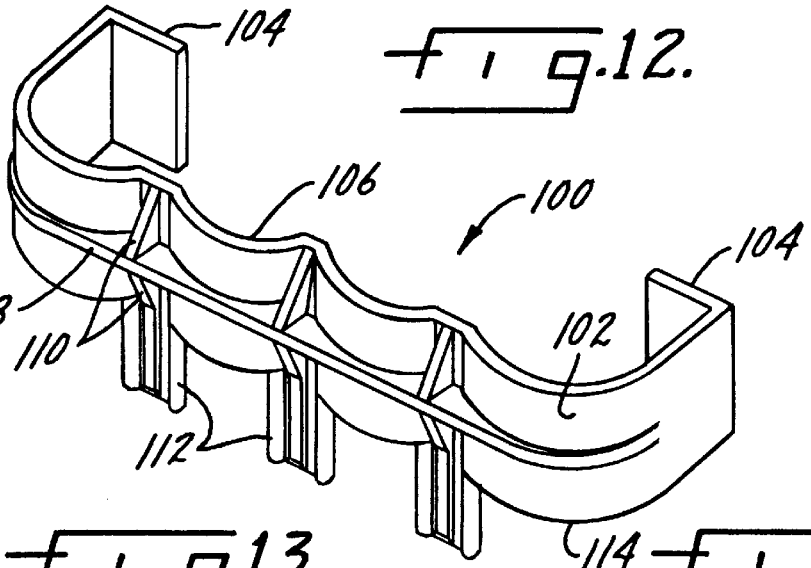
FIG. 12 is a perspective view of a battery pack retention clip.
Figure 13:
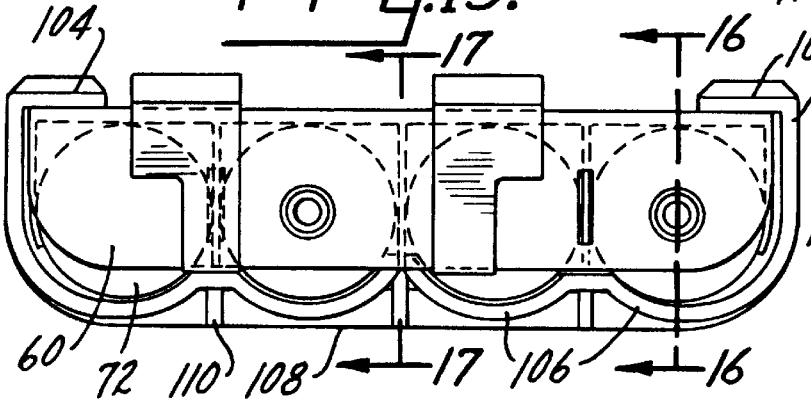
FIG. 13 is a top view of the battery pack, with the retention clip in position.
Figure 16:
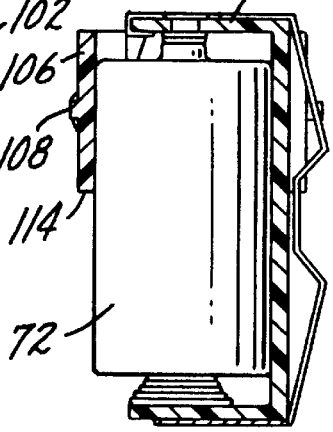
FIG. 16 is a section along plane 16—16 of FIG. 13.
Figure 14:
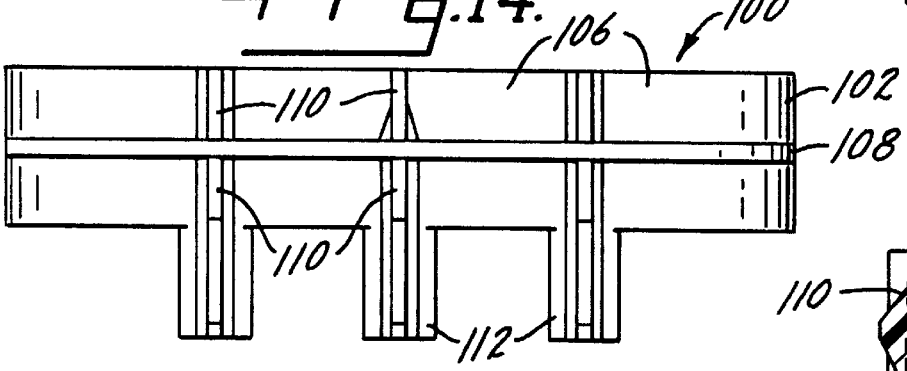
FIG. 14 is a front view of the retention clip.
Figure 17:
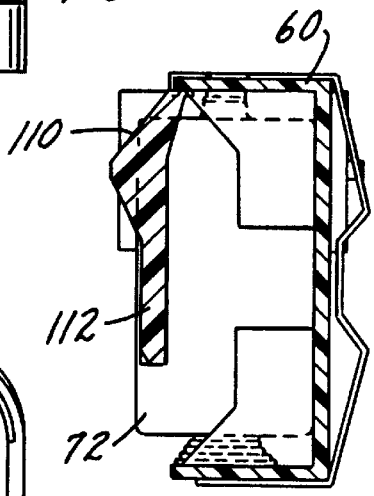
FIG. 17 is a section along plane 17—17 of FIG. 13.
Figure 15:
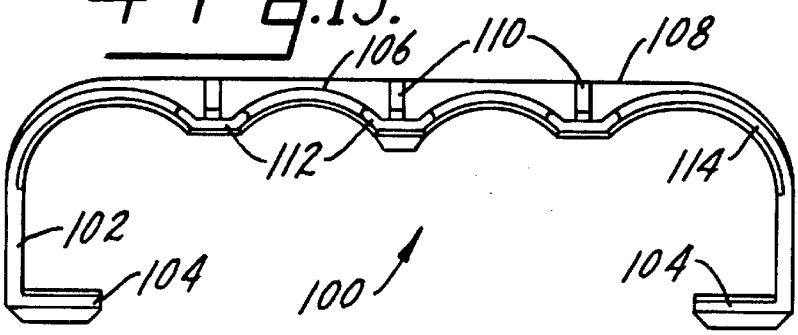
FIG. 15 is a top view of the retention clip.

Negative contact strap 86 is similar in that it has a portion 86*a* which is connected to spring 76 by a rivet 83, and as seen in FIG. 7, has a portion 86*b* that extends across the bottom wall 68 and then a portion 86*c* which extends along wall 60 and wraps around as is shown at 86*d*. Each of the contact straps 86 and 84 has an indentation indicated at 90 in FIG. 8. These indentations will be in contact with the cantilever arms 56*a* and 58*a* of the positive and negative spring contacts 56 and 58 when the battery pack is positioned within its cavity 26.

The battery pack retention clip is illustrated in FIGS. 12–17 and is indicated generally at 100. The clip 100 includes a body 102 having in-turned ends 104 which will wrap around the battery pack and retain the clip on it. The clip is removed by simply sliding it off of the battery pack in either direction. The body 102 includes a plurality, in this case four, arcuate wall areas 106 which are curved to fit around the individual batteries as particularly shown in FIG. 13 which shows the clip positioned upon the battery pack. There is a support rib 108 extending around the outside of the body 102 and a plurality of fillets 110 which extend between the rib 108 and the body. There are a plurality of vertical projections 112 which extend away from the body toward the bottom of the base 12 when the battery pack is fully inserted. The lower surface 114 of the retention clip will rest upon the peripheral wall of the base, again when the battery pack is inserted.

To replace the battery pack 60, it is first necessary to remove the cover 10 from the base 12. This is done by removal of the fasteners 16. The battery pack may then be easily grasped and removed with a minimum of effort. Once removed, the batteries may be conveniently replaced at a location away from the control module. After battery replacement the battery pack is again inserted within cavity 26 and the cover again attached to the control module base. The use of spring contacts on both the battery pack and within the control module itself eliminate the requirement for wires connected to the PC board. The control module is completely sealed by the use of gaskets 22 and 24 and the wires 34 are within the confines of the control module, eliminating any possibility of moisture seepage which would cause a short within the electrical circuits in the control module.

Whereas the preferred form of the invention has been shown and described herein, it should be realized that there may be many modifications, substitutions and alterations thereto.

The embodiments of the invention in which an exclusive property or privilege is claimed are defined as follows:

1. A battery-powered faucet control module including a housing, said housing having a base portion and a cover portion, said cover portion being removably attached to said base portion, an electric control board mounted in said housing base portion, an electrically-operated control valve associated with said housing and electrically connected to said control board, a cavity in said housing base portion, a removable battery pack positioned within said cavity and having positive and negative contact straps on the exterior thereof, said battery pack having spaced side walls and a bottom, batteries positioned between said side walls, each of said positive and negative contact straps being in contact with said side walls and extending across said bottom wall, and positive and negative spring contacts extending within said battery pack cavity and connected to said control board, said spring contacts being in mechanical and electrical contact, respectively, with said positive and negative contact straps when said battery pack is positioned within said cavity.

2. The battery-powered faucet control module of claim 1 wherein said spring contacts are in mechanical and electrical contact with said contract straps in the area where said contact straps extend across said bottom wall.

3. The battery-powered faucet control module of claim 2 wherein each of said contact straps has an indentation in the area where said contact straps extend across said battery pack bottom wall.

4. The battery-powered faucet control module of claim 3 wherein each of said spring contacts has a cantilever arm, said cantilever arms being in mechanical and electrical contact with said contact straps at said indentations.

5. The battery-powered faucet control module of claim 1 wherein said battery pack has battery contacts on the inside of said side walls, which battery contacts have portions extending through said side walls and in engagement with said contact straps.

6. The battery-powered faucet control module of claim 1 including a removable retention clip positioned about said battery pack to retain the batteries therein.

7. A battery-powered faucet control module including a housing, said housing having a base portion and a cover portion, said cover portion being removably attached to said base portion, an electric control board mounted in said housing base portion, an electrically-operated control valve associated with said housing and electrically connected to said control board, a cavity in said housing base portion, a removable battery pack positioned within said cavity and having positive and negative contact straps on the exterior thereof, and positive and negative spring contacts connected to said control board and in mechanical and electrical contact, respectively, with said positive and negative contact straps when said battery pack is positioned within said cavity.

8. The battery-powered faucet control module of claim 7 wherein said spring contacts are mounted in said second cavity.

9. The battery powered faucet control module of claim 7 wherein said spring contacts are mounted directly to said control board.

10. A battery-powered faucet control module including a housing, said housing having a base portion and a cover portion, said cover portion having a peripheral sealing gasket attached thereto and said base portion having a peripheral sealing gasket attached thereto, said cover portion being removably attached to said base portion, an electric control board mounted in said housing base portion, an electrically-operated control valve associated with said housing and electrically connected to said control board, a cavity in said housing base portion, a removable battery pack positioned within said cavity and having positive and negative contact straps on the exterior thereof, and positive and negative spring contacts connected to said control board and in mechanical and electrical contact, respectively, with said positive and negative contact straps when said battery pack is positioned within said cavity.

* * * * *

UNITED STATES PATENT AND TRADEMARK OFFICE

CERTIFICATE OF CORRECTION

PATENT NO. : 5,988,588
DATED : November 23, 1999
INVENTOR(S) : Charles S. Allen et al It is certified that error appears in the above-identified patent and that said Letters Patent is hereby corrected as shown below:

On the title page item [73], should read --Sloan Valve Company.--

Signed and Sealed this

Twenty-third Day of May, 2000

*Attest:*

Q. TODD DICKINSON

*Attesting Officer*

*Director of Patents and Trademarks*